United States Patent [19]

Braun et al.

[11] 4,004,968

[45] Jan. 25, 1977

[54] CONSECUTIVE MULTI-PLY FORMERS WITH AN UNENCUMBERED DOFFER FELT

[75] Inventors: Heinz Braun; Hans Dahl, both of Ravensburg; Jost Hefter, Fenken; Wolf-Gunter Stotz, Ravensburg, all of Germany

[73] Assignee: Escher Wyss G.m.b.H., Ravensburg, Germany

[22] Filed: May 27, 1975

[21] Appl. No.: 580,774

Related U.S. Application Data

[63] Continuation of Ser. No. 423,121, Dec. 10, 1973, abandoned.

[30] Foreign Application Priority Data

Dec. 11, 1972 Switzerland ..... 17971/72

[52] U.S. Cl. ..... 162/304; 162/306; 162/317; 162/318; 162/DIG. 7

[51] Int. Cl.[2] ..... D21F 1/04; D21F 1/40; D21F 1/50; D21F 11/08

[58] Field of Search ..... 162/304, 306, 317, 318, 162/352, 370, 133, 214, 217, DIG. 7

[56] References Cited

UNITED STATES PATENTS

| | | | |
|---|---|---|---|
| 3,072,180 | 1/1963 | Judrey | 162/370 X |
| 3,272,692 | 9/1966 | Hayes et al. | 162/317 |
| 3,434,922 | 3/1969 | Ely | 162/DIG. 7 |
| 3,795,576 | 3/1974 | Watanabe | 162/318 |

FOREIGN PATENTS OR APPLICATIONS

| | | | |
|---|---|---|---|
| 871,247 | 6/1961 | United Kingdom | 162/317 |

*Primary Examiner*—S. Leon Bashore
*Assistant Examiner*—Richard V. Fisher
*Attorney, Agent, or Firm*—Kenyon & Kenyon Reilly Carr & Chapin

[57] ABSTRACT

A wire is passed over the suction breast roll between the formed paper web and the doffer belt or the previously formed paper webs and doffer belt. The doffer felt is disposed in an unencumbered fashion over each of a plurality of consecutive suction breast rolls. The wire is removed from the web at a downstream point outside the dewatering influence of each breast roll. Stripping of the wire from the paper web is aided by various suction devices or couch rolls at this latter point.

4 Claims, 5 Drawing Figures

CONSECUTIVE MULTI-PLY FORMERS WITH AN UNENCUMBERED DOFFER FELT

This is a continuation, of application Ser. No. 423,121 filed Dec. 10, 1973, now abandoned.

This invention relates to a paper machine.

Paper machines have been known to have a number of consecutively disposed formers interconnected by a doffer felt for purposes of producing multi-layer cartons. Generally, each former has a breast box and a suction breast roll with at least one suction box in the roll. The suction box has usually been maintained at a negative pressure to dewater a paper web being formed in the former. In addition, it has been known to shrink-fit cylindrical dewatering wires on the suction breast rolls so that when paper forming material is fed to the wires by the breast box, a paper fleece can form along a sheet-forming zone of the roll and a paper web formed from the fleece. The paper web must thereafter be disengaged from the felt or combined with a paper web previously adhered to the felt. This operation gives rise to contrary requirements with regard to web water content. This, in turn, leads to difficulties which increase as the output of the machine increases.

Generally, a high water content is necessary for the paper webs to stick together satisfactorily. However, if the web is to be satisfactorily disengaged from the roll, the web must have some strength. If too much water is removed from the web for the sake of disengagement, a poor adhesion results between the web and the preceding and/or following carton layer. On the other hand, if the web has a fairly high water coontent for the sake of a good adhesion, the risk of the web dropping off the felt increases.

Other difficulties arise since the use of a negative pressure in the roller to assist in dewatering of the web makes disengagement difficult. Also, in the case of long suction breast rolls for wide paper webs, the removal of the stripped water becomes a problem.

It has also been known, for example that paper manufacturing machines may be constructed with cylindrical screens and couch rolls in order to squeeze a formed paper layer under the external tangential pressure of the couch roll. In such machines, the water content of the paper layer is to be eliminated as the paper leaves the nip between the cylinder and the couch roll. As a result, as noted above, since too much water is removed, a poor adhesion results between the web and preceding and/or following paper layer.

Accordingly, it is an object of the invention to enable the output of a paper machine to be increased.

It is another object of the invention to improve the adhesion of a paper web with a travelling felt.

It is another object of the invention to facilitate the removal of a formed paper web from a suction breast roll.

Briefly, the invention provides a paper machine having a plurality of consecutively disposed formers which are interconnected by a doffer felt with a long wire over each former with a portion of each wire extendiing along the doffer felt with the formed paper web therebetween. Each former includes a breast box, suction breast roll and at least one suction box in the roll for dewatering the paper web under negative pressure. The wire is disposed to be guided over the breast roll and additional guide rolls are provided to guide the wire over the breast roll and along the felt in an endless path.

The wire is used to ensure the disengagement of the formed paper web from the suction breast roll. Thus, the freshly formed paper web can be joined satisfactorily to a paper web already on the felt, or to the felt itself, with simultaneous dewatering in the portion of the wire extending along the felt. In order to improve the dewatering of the web in this portion, a dewatering means is used in cooperation with the wire. This feature helps to provide control of the moisture of the joined-together webs sticking to the felt in accordance with requirements.

In order to facilitate disengagement of the wire from the paper web, a suitable means is provided downstream of a former. This means is in the form of a doffer roll including a suction box, a couching roll or the like.

In the case of a machine having a first suction box disposed near a sheet-forming zone of the roll, and at least oone more suction box which follows in the direction of movement, the additional suction box can terminate at a point downstream of the place where the long wire disengages from the roll so that water hurled out of the orifices in the roll is hurled clear of the long wire. This feature makes it possible for the negative pressure operative in the roller after the sheet-forming zone to be adjusted independently of the requirements of such zone, for instance, so that the water is sucked into, and retained in, the roller orifices against centrifugal force. After the end of this suction box, where the negative pressure effect ceases, such water can be hurled out into a water box without sticking and damaging the already formed paper web. This feature also facilitates removal of the water from inside the roll, since much of the screen water is hurled out into the water box.

These and other objects and advantages of the invention will become more apparent from the following detailed description and appended claims taken in conjunction with the accompanying drawings in which:

Figure 1:
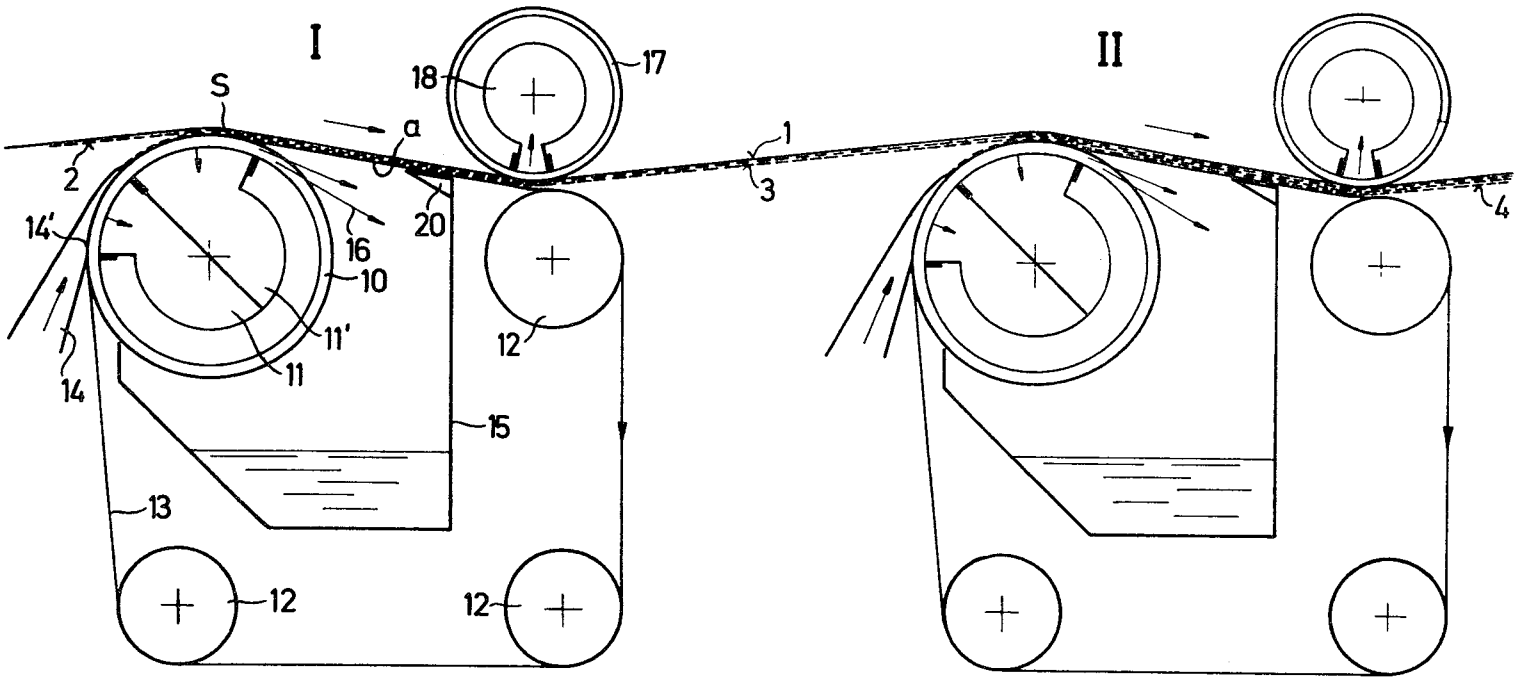
FIG. 1 illustrates a partial view of a number of formers of a paper machine utilizing a wire according to the invention.

Referring to FIG. 1, the paper machine includes a plurality of consecutively disposed formers I, II ony two of which are shown for simplicity. This machine can be used to form multi-layer carton and uses a doffer felt 1 to interconnect the formers. As shown, the doffer felt 1 is supplied to the left-hand former I, as viewed, with a paper web 2 already thereon. The first former I applies an additional layer 3 and the next former II, another layer 4. For the sake of simplicity only one former will be described in detail as all are identical.

The former I includes a suction breast roll 10 having two suction boxes 11, 11'. The roll 10 is mounted in a breast box 14 which supplies material for forming a paper web within a sheet-forming zone 14' of the roll 10. In addition, a wire 13 extends over the roll 10 as well as over guide rolls 12 so as to move through an endless path. A water box 15 is disposed downstream of the roll 10 to receive water from the wire 13 as the water is hurled out in the direction indicated by arrows 16 from apertures (not shown) in the roll 10. As can be gathered from FIG. 1, the wire 13 leaves the roll 10 at a departure or disengagement zone or place S, and has a section or portion *a* which extends along the felt 1 in co-extensive relation to sandwich the paper web 3 therebetween.

A means for boosting the disengagement of the wire 13 from the web 3 is mounted at the place where portion *a* of wire 13 ends. This means is in the form of a doffer roll 17 which is a suction roll and which includes a suction box 18. The rear wall of the box 15, which serves to intercept the water from the wire 13 has a doctor or similar device 20 which serves to scrape off water coming from the wire 13 and thus helps to dewater the paper web 2, 3 which is on the portion *a* of the wire 13.

As can be gathered from FIG. 1, the entry orifice of the box 11 is disposed at the sheet-forming zone 14'. The negative pressure in the box 11 can therefore be controlled to suit the requirements of the zone 14'. The second suction box 11' extends from the end of the zone 14', as considered in the direction of movement of the wire 13, to a point after the place S of disengagement of the wire 13. In this arrangement, the negative pressure in the box 11' is preferably such that water from the wire 13 can just enter the orifices (not shown) of the roll 19 against centrifugal force and then, possibly and to a lesser extent, the box 11'. After leaving the box 11', where the negative pressure effect ceases, the water which has come from the wire 13 and which is in the orifices in the roll 10 is hurled out in the direction indicated by the arrows 16. Since the end of box 11' is disposed after the place S, the water issuing tangentially from the roll 10 is hurled away from the wire 13 and cannot therefore impinge on the web 3 on the wire 13 and possibly damage the web 3.

In operation, the breast box 14 of each former unit feeds the material - i.e. a suspension of paper fibers and solids in water - to the roll 10, the fibers and solids being deposited on the wire 13. A paper fleece forms thereon in known manner, becomes joined to the web 2 supplied from the felt 1 and forms the layer 3 on the web 2. The web 2, 3 on moving between the felt 1 and wire 13 is gravity dewatered, the effect being boosted by the doctor 20. As shown, the doffer felt 1 is disposed over each suction breast roll 10 in unencumbered fashion. Thus, the newly formed layer 3 (i.e. web) is guided over the breast roll 10 in a non-pressed condition (as opposed to the situation in which a couch roll is used over a cylinder screen 1) together with the previously formed paper web 2. At the end of section *a* and upon passing through the nip of the doffer roll 17 and a guide roll 12, the felt 1 together with the web 2, 3 disengages from the wire 13. In this embodiment, such disengagement is assisted by the negative pressure in the suction box 18.

Figure 2:
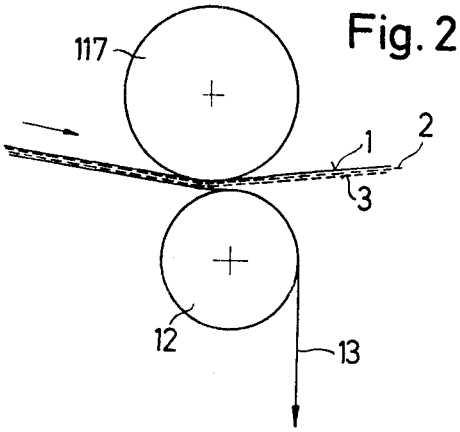
FIG. 2 illustrates a side view of a means for boasting disengagement of a web from the wire.
Figure 3:
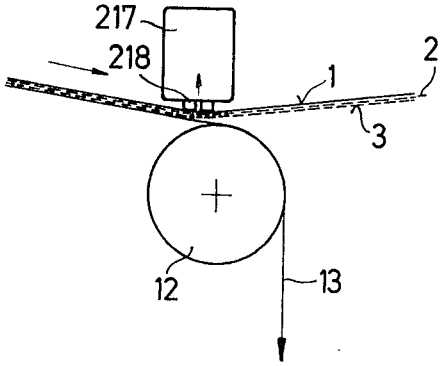
FIG. 3 illustrates a view similar to FIG. 2 of a modified boosting means.

Referring to FIGS. 2 and 3, which show parts of FIG. 1, other means can be used to improve the disengagement of the web from the wire. Parts corresponding to FIG. 1 have the same reference. In FIG. 2, the suction roll serving as the disengaging roll is replaced by a solid disengaging roll 117 which provides the known couching effect. In FIG. 3, a tubular suction device 217 is used for the same purpose. This device 217 has a strip or lead-like nozzle 218 across which the felt 1 slides.

Figure 4:
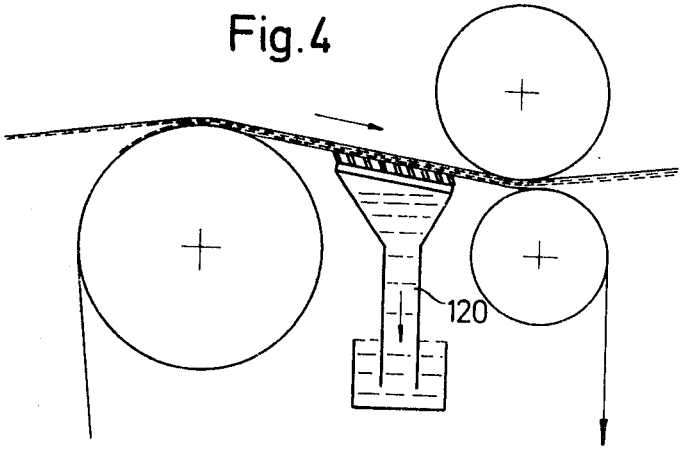
FIG. 4 illustrates a view of a dewatering means used in conjunction with the wire according to the invention.
Figure 5:
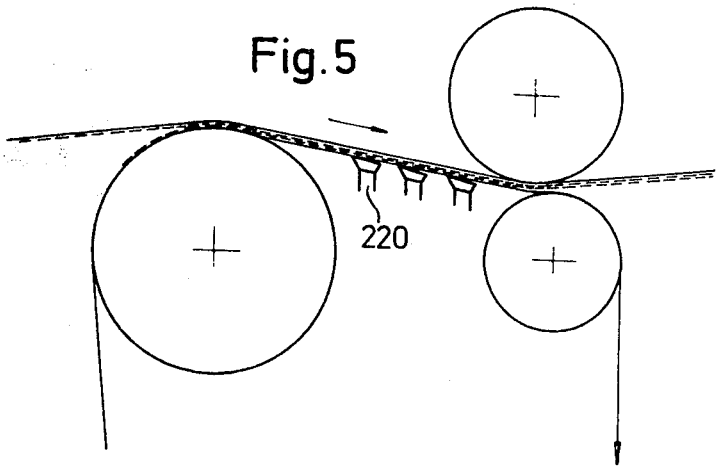
FIG. 5 illustrates a view of a modified dewatering means.

Referring to FIGS. 4 and 5, the doctor 20 of FIG. 1 can be replaced by other dewatering means such as wet suction device 120 with an overflow (FIG. 4) or suction strips or ledges 220 (FIG. 5).

Although the roll 10 is shown as having two suction boxes 11, 11', any number of suction boxes, disposed consecutively in relation to the direction of wire movement, can be used. The negative pressure in the suction breast roll can then be given any required pattern. Also, the doffer roll 17 of FIG. 1 can comprise a number of suction boxes.

What is claimed is:

1. A paper machine comprising a plurality of consecutively disposed formers, each former including a breast box, a suction breast roll and at least one suction box in said roll for dewatering a paper web formed by said former under negative pressure;

a doffer felt extending between said formers over each said suction breast roll of each former in unencumbered fashion;

a plurality of guide rolls about each said former; and a long wire extending about each said breast roll and the related guide rolls, said wire having a portion extending along said doffer felt to dispose the formed paper web therebetween.

2. A paper machine comprising a plurality of consecutively disposed formers, each former including a breast box, a suction breast roll, at least one suction box in said roll for dewatering a paper web formed by said former under negative pressure and a water box downstream of said roll to receive water;

a doffer felt extending between said formers, said doffer felt being disposed over each said suction breast roll or each former in unencumbered fashion to receive a fresh web so that the resulting paper web is guided over said breast roll in a non-pressed condition;

a plurality of guide rolls about each said former;

a long wire extending about each said breast roll and the related guide rolls in an endless path, said wire having a portion extending along said doffer felt to dispose the formed paper web therebetween for gravity dewatering of the web; and a dewatering means within each said water box adjacent to said wire portion for removing water from said wire.

3. A paper machine as set forth in claim 2 wherein said wire disengages from said breast roll at a predetermined place and wherein said suction box within said roll is disposed in a sheet-forming zone of said breast roll, and at least a second suction box is disposed within the breast roll and downstream of said first suction box, said second suction box terminating at a point downstream of said place where said wire disengages from said breast roll whereby water hurled from said breast roll is hurled clear of said wire into said water box.

4. A paper machine as set forth in claim 3 wherein said wire is disengaged from the formed paper web downstream of each former and further comprising means downstream of each said former for boosting disengagement of the formed paper web from said wire at one end of said portion.

* * * * *